United States Patent [19]

Tuominen

[11] 4,164,073

[45] Aug. 14, 1979

[54] APPARATUS FOR FEEDING AND BENDING SEED PLATE LUG STRIPS

[75] Inventor: Pertti Tuominen, Sorkka, Finland

[73] Assignee: Lonnstrom OY, Finland

[21] Appl. No.: 876,129

[22] Filed: Feb. 8, 1978

[30] Foreign Application Priority Data

Feb. 8, 1977 [FI] Finland ..... 770417

[51] Int. Cl.[2] ..... B23P 19/04; H01M 4/00

[52] U.S. Cl. ..... 29/731; 29/623.1; 113/1 N; 113/116 P; 53/218

[58] Field of Search ..... 29/730, 731, 623.1; 53/218, 188, 190, 571, 573; 113/1 N, 113 D, 116 P

[56] References Cited

U.S. PATENT DOCUMENTS

| | | | |
|---|---|---|---|
| 956,994 | 5/1910 | Peck | 53/218 |
| 2,066,449 | 1/1937 | Barrett | 53/218 |
| 2,410,393 | 10/1946 | Rines et al. | 53/218 |
| 3,031,812 | 5/1962 | Mosse | 53/218 |
| 3,777,452 | 12/1973 | Koenders | 53/218 |
| 3,832,829 | 9/1974 | Stout | 53/218 |
| 4,026,000 | 5/1977 | Anderson | 29/730 |
| 4,085,564 | 4/1978 | Focke | 53/218 |

FOREIGN PATENT DOCUMENTS

| | | | |
|---|---|---|---|
| 693716 | 7/1953 | United Kingdom | 53/218 |

*Primary Examiner*—Charlie T. Moon
*Assistant Examiner*—Daniel C. Crane
*Attorney, Agent, or Firm*—Steinberg and Blake

[57] ABSTRACT

An apparatus for feeding and bending lug strips which are to be attached to seed plates in electrolytic refining plants includes a tool structure capable of bending an initially flat lug strip around a supporting rod in preparation for fixing free ends of the bent lug strip to an edge region of a seed plate. This tool structure is carried by an operating structure which operates the tool structure so as to move it between an initial starting position where the lug strip is in a flat condition and an end position where the lug strip is bent into a substantially U-shaped configuration, the tool structure bending the lug strip during movement between the starting and end positions thereof. In addition a suitable structure is provided for moving the tool structure between a working station where the above operations take place and a receiving station where a flat lug strip is received from a suitable supply.

15 Claims, 3 Drawing Figures

APPARATUS FOR FEEDING AND BENDING SEED PLATE LUG STRIPS

BACKGROUND OF THE INVENTION

The present invention relates to apparatus for feeding and bending lug strips which extend around a supporting rod and are attached to seed plates in electrolytic refining plants.

By way of the apparatus of the invention lug strips are fed to a working station where they are bent around a supporting rod in preparation for being fixed, as by rivetting, for example, to an edge region of a seed plate.

In electrolytic refining plants seed plates are produced by a suitable machine for the purpose of electrolysis, these seed plates being carried by supporting rods usually by way of so-called lug loops. These lug loops are formed by bending elongated lug strips around the supporting rod or an auxiliary rod and rivetting the bent lug strip to an edge region of the seed plate.

According to known constructions the lug strip is freely dropped into a bending position and then bent by way of suitable separate bending implements. Such known constructions have a number of drawbacks. In the first place, these known structures are relatively complex and the operations require a number of consecutive steps with the result that there is a great likelihood of trouble with these known constructions. In addition, the lug strips are made of a seed plate having a thin margin while also having a great length, so that these strips become undesirably curved or bent upon impact at the termination of their free fall.

It has also been observed that there is a considerable inaccuracy with respect to the attachment of the conventional lug strip to the edge region of a seed plate, as a result of the considerable free space which the free dropping requires.

Moreover, the known structures are dependent upon a particular sequence in which the seed plates and supporting rods are conveyed, so that prior art constructions are only suitable for use in connection with a particular transporting system.

SUMMARY OF THE INVENTION

It is, therefore, a primary object of the present invention to provide an apparatus which will avoid the above drawbacks.

In particular, it is an object of the present invention to provide an apparatus of the above general type which is simple in its construction and which is not likely to be a source of trouble.

Furthermore it is an object of the present invention to provide an apparatus of the above type which makes it possible to supply the lug strips in a fully controlled manner.

Moreover it is an object of the present invention to provide an apparatus according to which it is possible to feed and bend lug strips in a manner which is completely independent of the transporting sequence of the seed plates and supporting rods.

According to the invention the apparatus for feeding a lug strip and bending the same around a supporting rod in preparation for fixing free ends of the bent lug strip to an edge region of a seed plate in an electrolytic refining plant includes a tool means for bending a lug strip around the supporting rod and including a holding means for holding a lug strip initially in a flat condition against a supporting rod in preparation for bending the lug strip around the supporting rod. This tool means has a starting position where the lug strip is held by the holding means of the tool means in its initial flat condition while the tool means has an end position where the lug strip is bent around the supporting rod with the tool means being movable from this starting position to its end position during bending of the lug strip and then being movable back from the end position to the starting position in preparation for receiving the next lug strip. An operating means is operatively connected to the tool means for carrying the latter and operating the tool means to move the same between its starting position where the holding means holds the lug strip in its initial flat condition and its end position so that during movement between its starting and end positions the lug strip will be bent around a supporting rod. A frame means carries the operating means, and a moving means is operatively connected with one of the other means to move the tool means between a working station where the operating means operates the tool means to bend a lug strip around the supporting rod and a receiving station where the tool means receives a flat lug strip which is held at the tool means by the holding means thereof. A supply means is situated at the receiving station for supplying a flat lug strip to the tool means when the latter is at the receiving station. The tool means after being operated by the operating means at the working station is moved by the moving means from the working station to the receiving station to receive the next lug strip from the supply means.

According to the invention the above frame means is swingably mounted and carries a fluid-pressure means which is connected to the tool means, the latter being vertically movable and having a lower surface against which the lug-strip is held. The structure for operating the tool means as well as for moving the latter up and down with respect to the frame means and also for turning the frame means to displace the tool means between the receiving and working stations may take the form of suitable fluid-pressure means such as suitable cylinders with pistons therein.

With the above structure of the invention, it is possible to handle the lug strips in a controlled manner enabling the many drawbacks of previously known constructions to be completely eliminated. Furthermore, the feeding and bending of the lug strips takes place with the apparatus of the invention in a manner which is completely independent of the transporting sequence of the seed plates and supporting rods. It is moreover possible by way of the structure of the invention to bend even relatively long lug strips in a rapid manner without risking any detrimental deformation of the lug strip.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
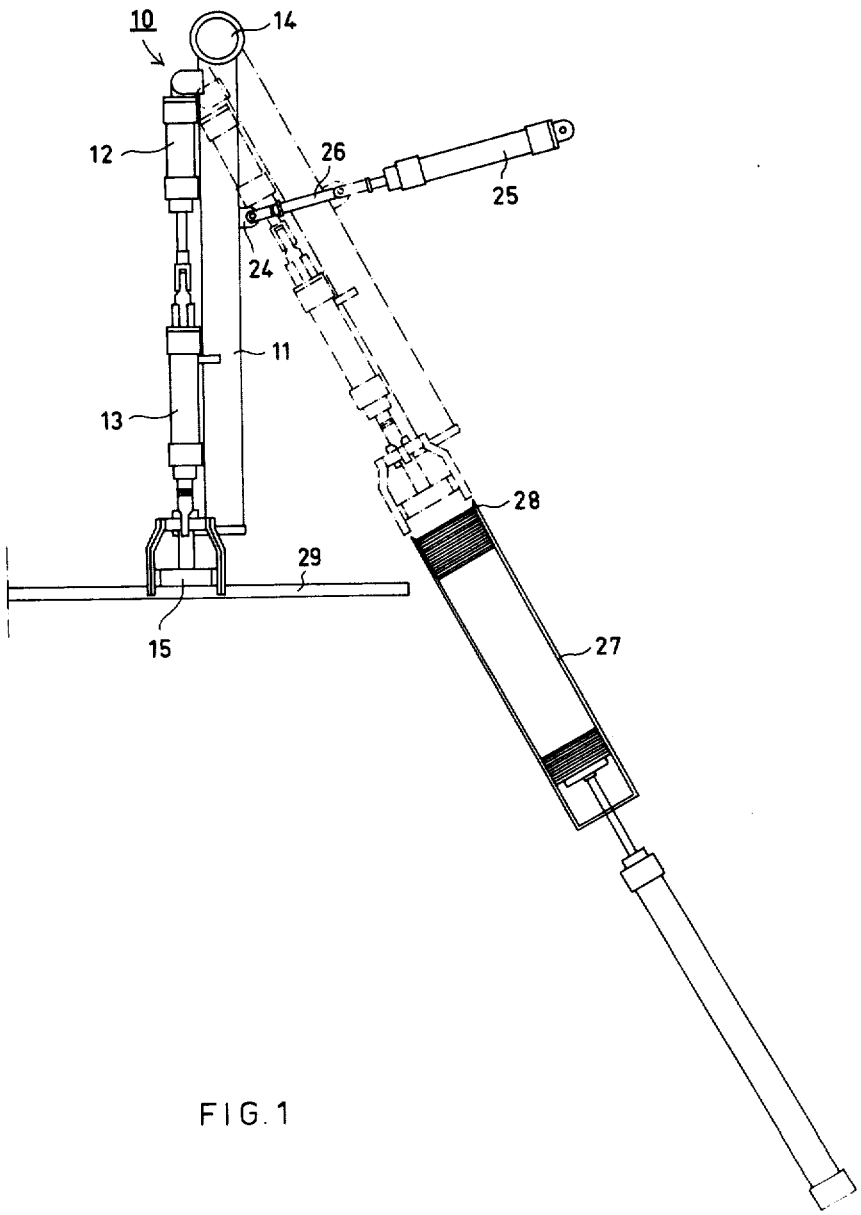
FIG. 1 is a schematic cross section at the rivetting line in an electrolytic refining plant where seed plates are attached to the supporting rods by way of utilizing the lug strip feeding and bending apparatus of the invention.

Referring to FIG. 1, there is schematically shown therein an apparatus of the invention for feeding and bending the lug strips. This apparatus includes a frame means 11 in the form of a freely hanging elongated bar having fixed to its top end a sleeve through which a stationary supporting rod 14 extends, this supporting rod 14 thus forming a support means which supports the frame means 11 for turning movement about the horizontal axis of the supporting rod 14. Thus the frame means 11 normally hangs down from the support means 14 while being turnable about the horizontal axis thereof. The apparatus also includes a number of fluid pressure means of which the fluid pressure means 12 and 13 are shown in FIG. 1 to the left of the frame means 11. Each of the fluid pressure means includes a cylinder which is supplied in a controlled manner with a fluid under pressure such as air or a suitable liquid, so that the fluid pressure means of the invention can either be pneumatic or hydraulic, and the pistons of the fluid pressure means respectively have piston rods which extend outwardly beyond the cylinders thereof. Also the apparatus includes a tool means 15 which is capable of acting on a lug strip so as to bend the latter around a supporting rod. In addition, the apparatus can include a further fluid pressure means 25 which may be pneumatic or hydraulic and which has its piston rod pivotally connected by way of a link 26 to lug 24 which are fixed to the frame means 11. Thus, the fluid pressure means 25 is supported for turning movement at its upper right end as seen in FIG. 1 about a stationary horizontal axis while the flow of fluid under pressure to and from the means 25 will cause longitudinal displacement of the link 26 so as to turn the frame means 11 between the solid and dot-dash line positions indicated in FIG. 1. Suitable unillustrated controls are provided for controlling the supply of fluid under pressure to and from the pneumatic or hydraulic fluid pressure means 12, 13, and 25. A supply means 27 is provided for supplying the lug strips 28 at a receiving station to which the tool means 15 is displaced in a manner described below so as to receive the lug strip 28 at the receiving station. This supply means 27 is in the form of an elongated magazine which is inclined as illustrated and which has a pair of opposed parallel walls as well as a third wall extending between the pair of opposed parallel walls forming in this way an elongated upright container inclined upwardly toward the left, as viewed in FIG. 1, and in which a stack of lug strips 28 are provided, these strips being displaced upwardly as required by way of the fluid pressure device shown at the lower right of FIG. 1. In this way there is always maintained at the top open end of this means 27 a lug strip 28 in a position ready to be received by the tool means 15 when the latter is displaced to the dot-dash line position at the receiving station formed by the top open end of the magazine 27.

Figure 2:
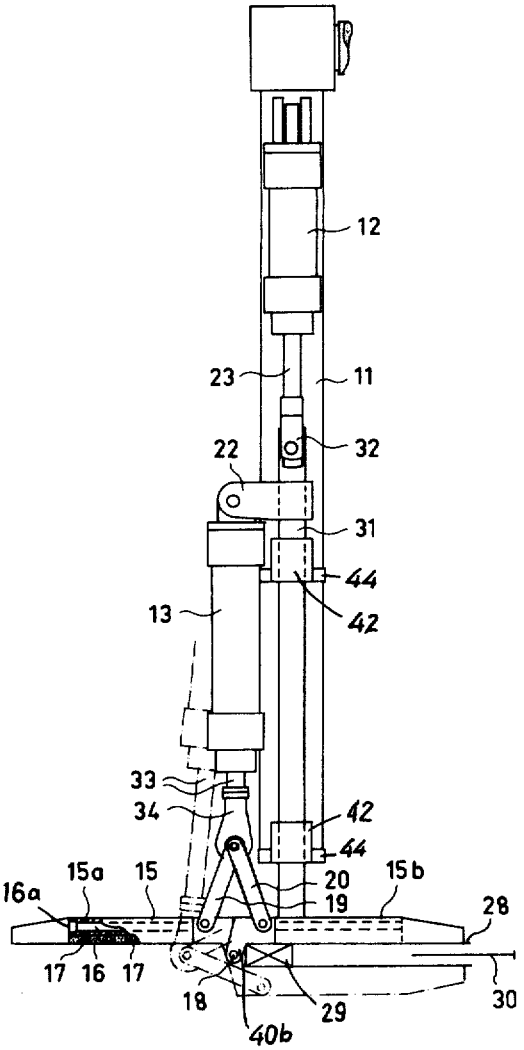
FIG. 2 is a schematic partly sectional side elevation of the apparatus of the invention as seen from the left of FIG. 1.
Figure 3:
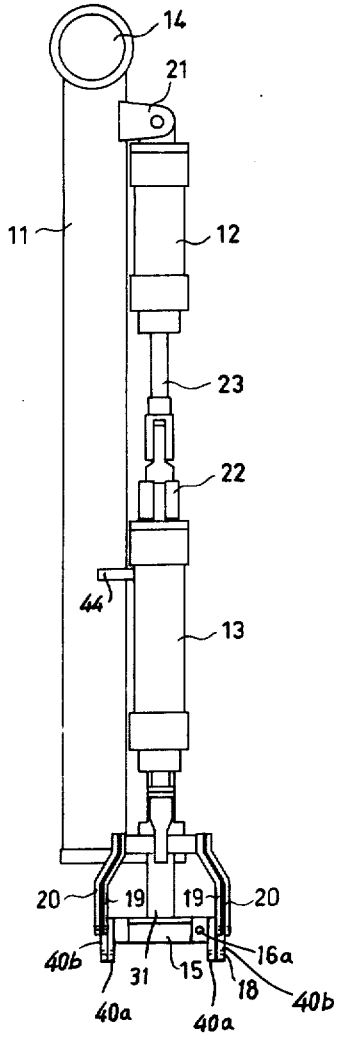
FIG. 3 is a schematic elevation of the structure of FIG. 2 as seen from the left of FIG. 2.

As may be seen most clearly from FIGS. 2 and 3, the cylinder of the fluid pressure means 12 is carried by lugs 21 which are fixed to extend from the upper end region of the frame means 11. The fluid pressure means 12 is capable of being operated to displace the tool means 15 up and down so as to control the elevation thereof. In this way it is possible to control the elevation of tool means 15 with respect to a supporting rod 29 around which a lug strip 28 is bent by the tool means 15 in the manner described below. The supporting rod 29 is shown schematically in FIG. 2 in a position extending perpendicularly to the plane of FIG. 2, the supporting rod 29 also being schematically indicated in FIG. 1. This supporting rod 29 is transported to the position indicated in FIGS. 1 and 2 by any suitable structure which forms no part of the invention. FIG. 2 also shows part of the seed plate 30 which has been transported also by a structure which forms no part of the present invention to the position indicated in FIG. 2 in preparation for having a bent lug strip 28 fastened as by rivetting to a free edge region of the seed plate 30.

The piston rod 23 of the fluid pressure means 12 is connected at 32 to the top end of an elongated bar 31 which is fixed at its bottom end to the tool means 15, in particular to an elongated jaw **15*b*, this elongated bar 31 being guided for longitudinal movement by way of sleeves 42 through which the bar 31 freely extends so as to be guided for the longitudinal movement. These sleeves 42 are fixed to the frame means 11 by way of suitable lugs 44. Thus as the rod 23 is moved up and down the tool means 15 will also be moved up and down through the longitudinal movement of the bar 31**.

The part of the bar 31 which extends above the upper guide sleeve 42 fixedly carries a lug 22 to which the top end of the fluid pressure means 13 is pivotally connected. This fluid pressure means 13 has a piston rod 33 which extends downwardly beyond the cylinder of fluid pressure means 13, and the lower end of the piston rod 33 fixedly carries a connecting member 34 which is operatively connected by way of a linkage means 19, 20, with the tool means 15, the structure which includes the pair of a fluid pressure means 12, 13 forming an operating means which is carried by the frame means 11 and which carries and is operatively connected to the tool means 15 for supporting the latter and for operating the same in the manner described in great detail below. Thus, through the linkage means 19,20 the movement of the piston rod 33 of the fluid pressure means 13 is transmitted to the tool means 15 for operating on a lug strip 28 in the manner described below.

The bending tool means 15 includes the pair of jaws **15*a* and 15*b* shown in FIG. 2. In the solid line position of the tool means 15 shown in FIG. 2 the lower surfaces are the jaws of 15*a* and 15*b* of coplanar, and in addition these jaws are provided with a suitable surface coating. The jaw 15*a* has at its end adjacent to the jaw 15*b* a pair of depending lugs 40*a*, while the jaw 15*b* has at its end adjacent to the jaw 15*a* a pair of depending lugs 40*b*, and the lugs 40*a* are situated from each other by a distance great enough to enable the lug strip 28 to be situated between these lugs 40*a* and adjacent with the bottom surfaces of the jaws 15*a* and 15*b*. Thus, the distance between the lugs 40*a* is at least slightly greater than the width of the lug strip 28. The pair of lugs 40*b* at the opposite sides of the jaw 15*b* overlap at their bottom ends the pair of lugs 40*a*, and each pair of overlapping lugs carries a hinge pin 18. These hinge pins have a common axis which forms the pivot axis between the jaws 15*a* and 15*b*. The jaw 15*b* remains fixed to the bottom end of the bar 31 while with the above structure the jaw 15*a* can turn through 180° from the solid to the dot-dash line position shown in FIG. 2 about the axis determined by the hinge pins 18**.

As has been indicated above, the tool means 15 includes a holding means releasably holding a lug strip 28 against the lower surfaces of the jaws **15*a* and 15*b*. This holding means takes the form of spaces 16 which are respectably formed in the interiors of the jaws 15*a*** and 15*b*, these spaces 16 being placed in an unillustrated manner in communication with a source of suction, by way of suitable, flexible tubes, and each connected to an opening such as the opening 16*a* shown in FIG. 2 which communicates with the space 16. In the same way the jaw 15*b* is connected to a source of suction, and these tubes have suitable valves so that the source of suction can be turned on and off. The spaces 16 of the jaws respectively communicate with the lower surfaces thereof through the passages 17 which have the configuration of suction cups so that when the spaces 16 are placed in communication with the source of suction this suction will be transmitted to the lower surfaces of the jaws by way of the space 16 and the passages 17.

Thus, when the tool means 15 is at the receiving station, the suction can be applied so as to cause the uppermost lug strip 28 to be held by suction against the lower coplanar surfaces of the jaws 15*a* and 15*b*, so that in this way this lug strip will be returned with the tool means to the working station shown in FIG. 2 where the bottom surface of the strip 28 is placed against the top surface of the supporting rod 29, after which the spaces 16 can be placed in communication with the outer atmosphere, thus eliminating the source of suction, while the rod 33 is then displaced downwardly, as viewed in FIG. 2, to cause the linkage 19, 20 to operate the tool means so as to situate the jaw 15*a* in the dot-dash line position shown in FIG. 2, thus bending the strip 28 around the rod 29.

The piston rod 33 carries a transverse pivot pin to which the top ends of the pair of links 19 are pivotally connected, these links being pivotally connected at their bottom ends to opposed side surface regions of the jaw 15*a*. In the same way the pair of links 20 are pivotally connected at their top ends to the pivot rod which extends transversely with respect to the piston rod 33, and the bottom ends of the links 20 are pivotally connected to opposed side surface regions of the jaw 15*b*. Thus, when the tool means 15 is in the starting position shown in FIG. 2, and assuming that a lug strip 28 is releasably held by the suction of the holding means against the lower coplanar surfaces of the jaws 15*a* and 15*b*, it is possible by controlling the elevation of the bar 31 through the fluid pressure means 12 to situate the bottom surface of the strip 28 at a central region thereof against the top surface of the supporting rod 29, and then by supplying fluid under pressure to the cylinder of the fluid pressure means 13 the piston 33 can be displaced downwardly so that the piston 13 swings toward the left, as view in FIG. 2, to the illustrated dot-dash line position while through the linkage means 19,20 the jaw 15*a* is turned about the axis determined by the hinge connection 18 from the solid to the dot-dash line position shown in FIG. 2, thus bending the lug strip 28 around the rod 29 providing for the lug strip 28 the substantially U-shaped configuration shown in FIG. 2 where the lug strip has free edge regions between which an edge region of the seed plate 30 is located so that with the parts in this position it is possible for an unillustrated rivetting means to rivet the opposed free edges of the bent strip 28 to the left edge region of the seed plate 30, as viewed in FIG. 2.

Assuming that the parts have the position shown in FIG. 1, then the fluid pressure means 12 can be operated to raise the tool means 15 to an elevation somewhat higher than the supporting rod 29, and of course this is done by raising the bar 31 so that the fluid pressure means 13 also moves upwardly with the bar 31 and the tool means 15. With the tool means 15 thus raised through a relatively short distance above the elevation shown in FIG. 2, it is possible to operate the moving means formed by the fluid pressure means 25 so as to swing the frame means 14 to the dot-dash line position shown in FIG. 1 thus displacing the tool means 15 to the receiving station at the top open end of the magazine 27. Then the fluid pressure means 12 is operated to displace the tool means 15 to the top open end of the magazine 27 and suction is now supplied so that the holding means operate to cause the uppermost lug strip 28 to adhere to the lower coplanar surfaces of the jaws of the tool means 15. Now the fluid pressure means 21 is again operated to displace this uppermost strip 28 together with the tool means 15 away from the receiving station and to the working station shown in the solid line position of FIG. 1 and also illustrated in FIGS. 2 and 3. For this purpose the fluid pressure means 25 is of course expanded so as to return the frame means 11 to the vertical position shown in FIG. 1. Thus the tool means 15 together with the lug strip 28, which is in a flat condition adhering to the bottom surface of the tool means 15, becomes situated at the rivetting location, and when the supporting rod 29 and seed plate 30 are in a suitable position for the rivetting operation, the cylinder of fluid pressure means 12 receives fluid under pressure to urge the bending tool means 15 and the lug strip 28 adhering to the underside thereof against the supporting rod 29, at which point the vacuum is terminated by placing the space 16 in communication with the outer atmosphere in a known manner. Now, the fluid pressure means 13 operates to cause the piston rod 33 to be displaced downwardly out of the cylinder of the means 13 in the manner described above, so that now the operating means acts through its linkage means 19, 20 so as to turn the jaw 15*a* through 180 degrees with respect to the jaw 15*b*, thus bending the lug strip 28 around the rod 29 in the manner shown schematically in FIG. 2. In this way the jaw 15*a* assumes the dot-dash line position shown at the bottom right part of FIG. 2. Thus in this way the lug strip 28 situated between the tool means 15 and the supporting rod 29 is bent around 180 degrees around the supporting rod 29. Finally, an unillustrated rivetting apparatus presses the free ends of the lug strip 28 against the opposed surfaces of the seed plate 30, and the lug strip 28 is fixed by rivetting to the seed plate 30. Now the rod 33 returns to its initial position, thus returning the jaw 15*a* to the solid position thereof shown in FIG. 2, and then the fluid pressure means 12 is operated to raise the tool means away from the bent lug strip 28 and now the next cycle of operations may begin.

Of course, it is to be understood that only one advantageous embodiment of the invention has been presented above. It is obvious to those skilled in the art that numerous modifications thereof can be made without going beyond the protective scope defined by the claims which follow below.

What is claimed is:

1. In an apparatus for feeding a lug strip and bending the same around a supporting rod in preparation for fixing free ends of the bent lug strip to an edge region of a seed plate in an electrolytic refining plant, tool means for bending a lug strip around the supporting rod and including a holding means for holding a lug strip initially in a flat condition against a supporting rod in preparation for bending the lug strip around the supporting rod and for picking up a lug strip from a supply means at a receiving station and holding the same during movement of the tool means from a receiving station to a working station, said tool means having a starting position where the lug strip is held by the holding means of the tool means at a working station in its initial flat condition and having an end position where the lug strip is bent around the supporting rod with said tool means being movable from said starting to said end position during bending of the lug strip and then being movable back from said end position to said starting position thereof in preparation for receiving the next lug strip, operating means operatively connected to said tool means for carrying the latter and for operating the tool means to move the same between its starting position where the holding means holds the lug strip in its initial flat condition and its end position so that during movement between its starting and end positions the lug strip will be bent around a supporting rod, frame means carrying said operating means, moving means operatively connected to one of said operating or frame means for moving said tool means between a working station where said operating means operates said tool means to bend a lug strip around a supporting rod and a receiving station where said tool means receives a flat lug strip which is held at said tool means by said holding means thereof, and supply means at said receiving station for supplying a flat lug strip to said tool means when the latter is at said receiving station, said tool means after being operated by said operating means at said working station being moved by said moving means from said working station to said receiving station to receive the next lug strip from said supply means.

2. The combination of claim 1 and wherein a support means supports said frame means for movement, said moving means being operatively connected to said frame means, and acting on said frame means to move the latter and said operating means and tool means carried thereby for displacing said tool means between said working and receiving stations.

3. The combination of claim 2 and wherein said support means supports said frame means for turning movement.

4. The combination of claim 3 and wherein said moving means is in the form of a fluid pressure means operatively connected to said frame means for swinging the latter with respect to said support means.

5. The combination of claim 1 and wherein said tool means in said starting position thereof has a downwardly directed substantially flat lower surface against which said holding means holds said lug strip when the latter is in its initial flat condition, said tool means including a pair of elongated jaws which are hingedly connected to each other and which have in the starting position of said tool means a pair of lower coplanar surfaces against which the lug strip is initially held in its flat condition by said holding means, said operating means being operatively connected to said jaws for turning one of said jaws with respect to the other about an axis determined by the hinged connection between said jaws for bending said lug strip around a supporting rod.

6. The combination of claim 5 and wherein said jaws are respectively formed with hollow interior spaces and with passages providing communication between said spaces and said lower surfaces of said jaws, said spaces being adapted to be placed in communication with a source of vacuum for providing through said vacuum and said spaces and passages said holding means for releasably holding a lug strip against said jaws.

7. The combination of claim 6 and wherein said passages terminate at said lower surfaces of said jaws in chambers having the configuration of suction cups.

8. The combination of claim 5 and wherein said operating means includes a linkage means operatively connected to said jaws forturning one of said jaws with respect to the other about an axis determined by the hinged connection between said jaws.

9. The combination of claim 8 and wherein said operating means includes a fluid pressure means having a cylinder and piston provided with a piston rod, and said piston rod being operatively connected with said linkage means for operating the latter.

10. The combination of claim 9 and wherein said linkage means includes a pivot pin carried by said piston rod and extending transversely thereto, a first pair of links pivoted to said pivot pin and to one of said jaws, and a second pair of links also pivoted to said pivot pin and both pivoted to the other of said jaws.

11. The combination of claim 10 and wherein said operating means includes an upright bar fixed to one of said jaws, said linkage means operating on the other of said jaws to turn the latter with respect to said one jaw which is fixed to said bar.

12. The combination of claim 11 and wherein said operating means includes a second fluid pressure means operatively connected with said bar for moving the latter longitudinally so as to control the elevation of said tool means, and said second fluid pressure means being carried by said frame means.

13. The combination of claim 12 and wherein said first-mentioned fluid pressure means is operatively connected with said bar to be supported thereby for movement therewith.

14. The combination of claim 13 and wherein said frame means carries a guide means which guides said bar for longitudinal movement.

15. The combination of claim 13 and wherein the means which fixes said first-mentioned fluid pressure means to said bar supports said first-mentioned fluid pressure means for free swinging movement about a horizontal axis.

* * * * *